United States Patent [19]

Bourque

[11] 4,209,941

[45] Jul. 1, 1980

[54] GROUNDED FLYING SAUCER TOYS

[76] Inventor: Edmond A. Bourque, 24 Rose La., Cumberland, R.I. 02864

[21] Appl. No.: 923,143

[22] Filed: Jul. 10, 1978

[51] Int. Cl.[2] ..... A63H 33/26

[52] U.S. Cl. ..... 46/230; 46/251

[58] Field of Search ..... 46/230, 251

[56] References Cited

U.S. PATENT DOCUMENTS

| | | | |
|---|---|---|---|
| 2,599,208 | 6/1952 | Starr | 46/230 |
| 2,849,819 | 9/1958 | Murphy et al. | 46/230 |

FOREIGN PATENT DOCUMENTS

| | | | |
|---|---|---|---|
| 1030745 | 5/1958 | Fed. Rep. of Germany | 46/251 |

*Primary Examiner*—Houston S. Bell, Jr.

*Attorney, Agent, or Firm*—Maurice R. Boiteau

[57] ABSTRACT

There is disclosed in the present application a motorized toy vehicle adapted to travel over a floor under its own power and to simulate on a miniaturized scale a popular concept of a space vehicle commonly referred to as a "flying saucer". The toy includes in addition to a drive for propelling the vehicle along the floor, a revolving dome shaped covering having a series of windows through which vari-colored flashing light is seen.

6 Claims, 2 Drawing Figures

GROUNDED FLYING SAUCER TOYS

The present application relates generally to improvements in motorized floor travelling toys and more particularly to such toys which simulate the appearance of the popular concept of a "flying saucer".

Toys which are adapted to move under their own power and to provide various other forms of motion or cyclic change are particularly appealing to children and consequently hold their attention for extended periods of time. In addition, toys which also stimulate the imagination of the children are highly regarded by parents and other adults as being especially beneficial in the development of children by arousing their curiosity and channelling in into constructive directions.

There have been prior attempts to provide toys which simulate flying saucers both in their exterior appearance and also flying or hovering ability. These, however, have not been entirely suitable for younger children in that, being adapted to flying, such toys are usually beyond the capacity of smaller children to control and additionally, when inadequately managed, are likely to cause at least minor damage to the interior of a house in which they are employed, typically by breaking glass or other fragile articles. Furthermore, the flying models which have been available have generally not included the characteristic features most commonly reported by those who have been responsible for "sightings" of flying saucers, namely: a revolving saucer shaped body and different colors of flashing lights.

It is accordingly an object of the present invention to provide a safe toy adapted to being operated by and to hold the attention of relatively young children and yet to offer considerable appeal for older persons.

Another object is to provide a toy which stimulates a child's imagination by providing a realistic simulation of the overall appearance and operation of a grounded flying saucer type vehicle.

Another important object is to provide a toy which may be used indoors with little likelihood of causing damage to the interior of the house.

In the achievement of the foregoing objects, a feature of the invention relates to a revolving dome which substantially covers a power source in the form of a battery pack and a motor and gear reduction unit which propels the flying saucer vehicle along the floor and also imparts a rotary motion to the dome. According to a related feature, the dome is formed with a plurality of translucent windows through which vari-colored flashing light is emitted from the interior of the dome.

Figure 1:
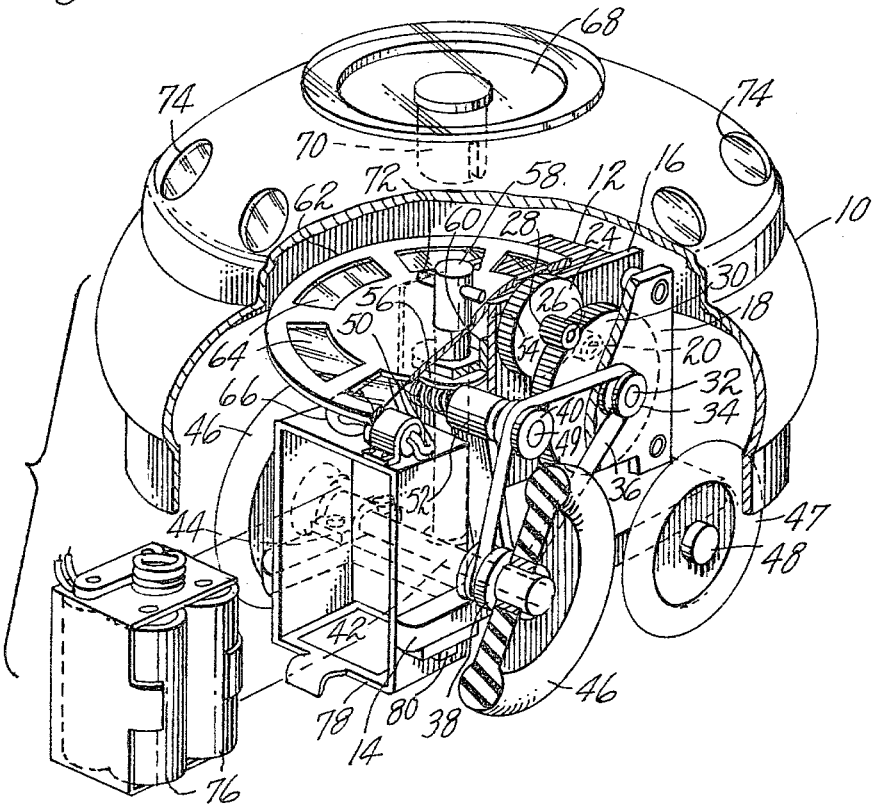
Figure 2:
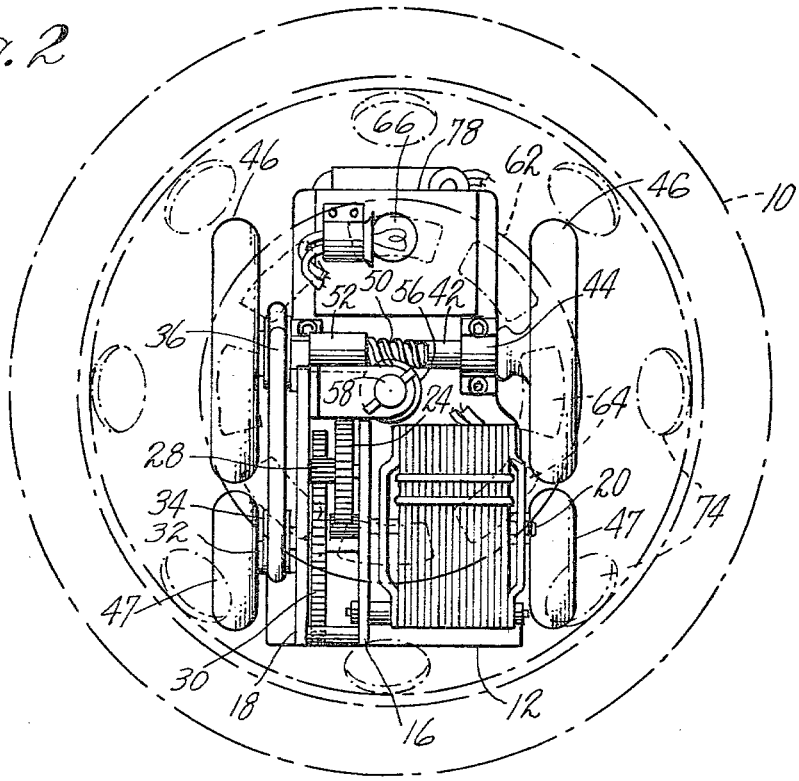

The foregoing objects and features of the invention will be more fully appreciated from the following detailed description of an illustrative embodiment taken in connection with the accompanying drawings in which:

FIG. 1 is a view in perspective of a flying saucer toy vehicle according to the present invention, with parts shown in separated relationship and a revolving dome shown partially broken away for clarity in depicting interior drive elements; and FIG. 2 is a plan view of the flying saucer toy vehicle depicted in FIG. 1.

Turning now to the drawings, there is shown a flying saucer toy vehicle including a dome 10 which substantially covers interior drive elements including a battery powered electric motor 12. The drive elements for the toy vehicle are mounted upon a chassis 14 and include in addition to the motor 12 which is fixed to the chassis, a two stage spur gear speed reduction supported between inner and outer plates 16 and 18 respectively, both fixedly secured to the frame of the motor. The output of the motor 12 is a shaft 20 on which is secured a pinion 22 meshing with a gear 24 fixed to a countershaft 26 appropriately journalled in bearings in the plates 16 and 18. A pinion 28 is also fixed to the countershaft 26 and meshes with a second gear 30 fixed to an output shaft 32 also journalled in appropriate bearings in the plates 16 and 18. Fixedly mounted on the shaft 32 outside the plate 18 is a drive pulley 34 over which passes a friction belt 36 which also engages driven pulleys 38 and 40 for performing the respective functions of propelling the vehicle and imparting a rotary motion to the dome 10.

For propelling the vehicle, the pulley 38 is fixed to a live rear axle 42, rotatably supported in a pair of pillow blocks one of which is seen at 44 in FIG. 1, fixedly mounted on top of the chassis 14. A pair of larger rear wheels 46 is fixedly secured one to each end of the axle 42 and a pair of smaller front wheels 47 is mounted, one on each end of a stationary fron axle 48.

For imparting a rotary motion to the dome 10, the pulley 40 is fixedly mounted on a shaft 49 whose inner end is cut in the shape of a worm 50. The shaft 49 is journalled in a bearing block 52 secured to a vertical transverse plate 54 and the worm 50 meshes with a worm wheel 56 fixed to a vertical shaft 58 journalled in a bracket 60 also fixed to the transverse plate 54. A color filter disk 62 carrying a plurality of different individual colored light filters 64 is fixedly mounted on the shaft 58 to transmit different colored light to the interior of the dome 10 from electric lamps one of which is shown at 66.

The dome 10 is formed with a relatively large central window 68 of a transparent plastic material from which fixedly depends a slotted sleeve 70, the slots of which embrace a pin 72 pressed into the shaft 58 for imparting the rotary motion to the dome. In addition to the central window 68, the dome 10 is also formed with a plurality of smaller generally peripheral windows or portholes 74 located at regular intervals, through which vari-colored light is emitted from the interior of the dome.

For powering the motor 12 and the lamps 66, there is provided a set of batteries 76 which are received in a case 78 fixedly mounted on the chassis 14. Electric current from the batteries 76 to the motor 12 and the lamps 66 is connected through a main slide switch 80, conveniently mounted on the underside of the chassis 14 near the battery case 78. In addition, a branch circuit through the lamps 66 includes a flasher switch (not shown) which causes the lamps to cycle on and off, thus adding to the feeling of activity associated with the toy vehicle.

Having thus disclosed my invention, what I claim as new and desire to secure by Letters Patent of the United States is:

1. A toy simulating a grounded flying saucer comprising a prime mover, a set of wheels on which the toy is adapted to being propelled along a generally horizontal surface, at least one of the wheels being a driving wheel, a speed reducer interposed between the prime mover and the driving wheel, a vertical shaft also coupled to the prime mover and a rotatable circular dome substantially enveloping the interior parts of the toy, mounted on and rotated by the vertical shaft as the toy is propelled along the surface.

2. A toy according to claim 1 further characterized in that the prime mover is an electric motor and the speed reducer is a two stage spur gear reduction.

3. A toy according to claim 1 further characterized in that the dome is formed with at least one translucent window and further comprising a battery powering the prime mover, at least one electric lamp on the interior of the dome connected to the battery and a flasher switch interconnected between the battery and the lamp whereby light from the flashing lamp is emitted through the window.

4. A toy according to claim 3 further comprising a plurality of generally equally spaced windows in the dome through which flashing light is emitted.

5. A toy simulating a grounded flying saucer comprising a prime mover, a set of wheels on which the toy is adapted to being propelled along a generally horizontal surface, at least one of the wheels being a driving wheel, a speed reducer interposed between the prime mover and the driving wheel, a vertical shaft also coupled to the prime mover, a dome covering the interior parts of the toy and rotated by the vertical shaft as the toy is propelled along the surface, a battery powering the prime mover, at least one electric lamp on the interior of the dome connected to the battery, a flasher switch interconnected between the battery and the lamp and a filter disc fitted with a plurality of different colored light transmitting filters, mounted on the vertical shaft and rotated thereby, the dome having at least one translucent window through which vari-colored flashing light is emitted from the flashing lamp and through the filters.

6. A toy according to claim 5 further comprising a plurality of generally equally spaced windows in the dome through which flashing light is emitted.

* * * * *